United States Patent [19]

De Lucchi

[11] Patent Number: 4,869,413

[45] Date of Patent: Sep. 26, 1989

[54] COUPLING INTERPOSED BETWEEN THE ROLLS OF A WIDENER ROLLER FOR SHEET MATERIALS

[75] Inventor: Cesare De Lucchi, Gallarate, Italy

[73] Assignee: Irga S.p.A., Milan, Italy

[21] Appl. No.: 209,921

[22] Filed: Jun. 21, 1988

[30] Foreign Application Priority Data

Jul. 8, 1987 [IT] Italy ..... 21218 A/87

[51] Int. Cl.[4] ..... D06C 3/06

[52] U.S. Cl. ..... 226/190; 26/103

[58] Field of Search ..... 242/76; 226/190; 26/99, 26/101, 102, 103, 104; 193/35 F, 37; 198/780

[56] References Cited

U.S. PATENT DOCUMENTS

| | | | |
|---|---|---|---|
| 868,098 | 10/1907 | Kiernan | 26/103 |
| 2,960,753 | 11/1960 | Robertson | 26/104 |
| 3,757,399 | 9/1973 | Hanssen | 26/104 X |
| 4,236,285 | 12/1980 | Gallant | 26/103 |
| 4,339,855 | 7/1982 | Demiere | 26/103 |

FOREIGN PATENT DOCUMENTS

| | | |
|---|---|---|
| 2724620A1 | 8/1978 | Fed. Rep. of Germany . |
| 3311095A1 | 3/1983 | Fed. Rep. of Germany . |

OTHER PUBLICATIONS

European Search Report—EP 88201181.0.

*Primary Examiner*—Daniel P. Stodola
*Assistant Examiner*—Phillip S. Han
*Attorney, Agent, or Firm*—Neuman, Williams, Anderson & Olson

[57] ABSTRACT

The coupling interposed between the rolls of a widener roller for sheet materials comprises a couple of mutually opposite ring-shaped flanges haveing an "L"-shaped cross-section. Each ring-shaped flange is composed by a first metal ring, and a second metal ring. The first metal rings are bonded to the inner surfaces of the edges of a couple of adjacent rolls which, together with other rolls, form the widener roller, and between the second metal rings a ring-shaped element of a flexible material is interposed.

7 Claims, 1 Drawing Sheet

Fig.1
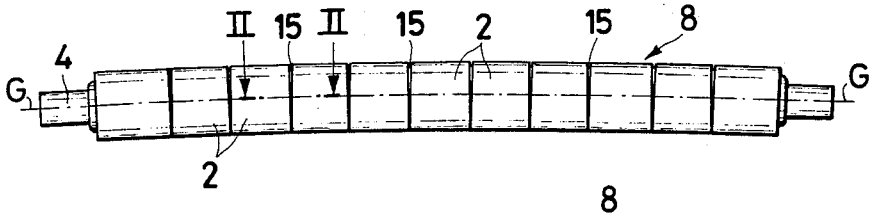
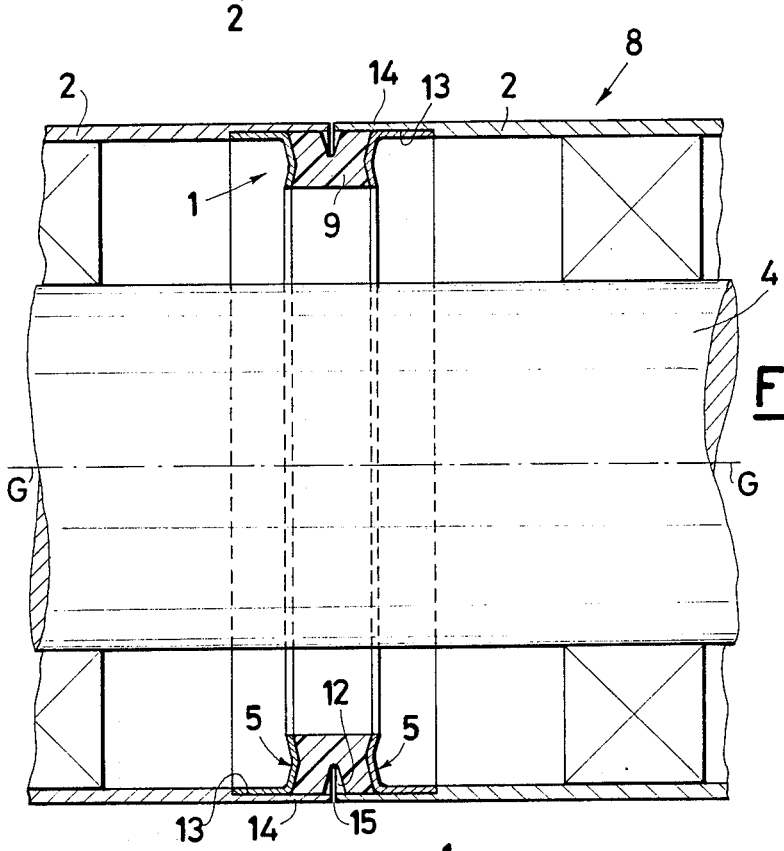
Fig.2
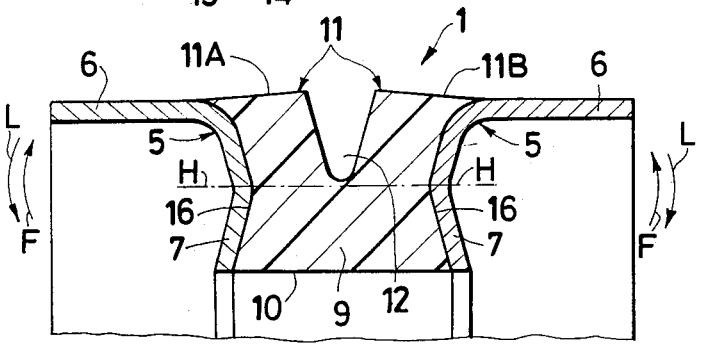
Fig.3

COUPLING INTERPOSED BETWEEN THE ROLLS OF A WIDENER ROLLER FOR SHEET MATERIALS

The present invention relates to a coupling interposed between the rolls of a widener roller for sheet materials such as paper, fabrics, plastics and still other materials.

The presently used widener rollers show a structure which comprises a metal shaft bent and keyed to the metal bearing frame of the machine wherein they are destined to operate.

On said bent shaft idle rolls are mounted, with the interposition of bearings, which are linked with one another by elastic couplings constituted by rings of a rubber material, having a diameter substantially equal to the diameter of the rolls they link together.

When the widener roller operates, the rolls revolve, integral with one another, on the shaft, and reproduce the bending thereof thanks to the elastic couplings, in which a same portion of ring of rubber material which constitutes them is subject to compression stresses, when it comes to be in the concave area, to tensile stresses when it comes to be in the convex area of the roller shaft around which it revolves, and, independently from the position, to the shear stresses due to the rolling which each roll close to the power applies to each roll close to the resistance.

The members which constitute the elastic couplings are therefore submitted to a plurality of stresses which are often particularly heavy, and which cause, as a consequence, the mechanical failure of the same coupling. The failure of the couplings can be also favoured by the escape of the lubricant and/or by the seepage of liquids coming from the processing of the sheet material which the widener roller has to treat.

The purpose of the present invention is to provide a type of coupling, interposed between the various rolls of a widener cylinder, having such a structure as to provide a strong, and simultaneously flexible, link between the rolls, so as to secure the correct functionality over time of the widener roller with which said type of coupling is associated.

Such purpose is achieved by a coupling interposed between the rolls of a widener roller for sheet materials, which comprises a ring-shaped element of an elastic material linking the adjacent rolls of said widener roller along a linking suface, characterized in that said linking surface is constituted by couples of surfaces substantially perpendicular to each other.

The advantages achieved by means of the present invention essentially derive from the fact that the both the stresses caused by the bending and the stresses caused by the rolling, which each roll transmits to the adjacent roll run through a coupling wherein the overall linking surace area is much larger than as of the couplings known from the prior art, thanks to the division into two couples of surfaces substantially perpendicular to each other of said surface, so that the value of the stresses per unit surface area is decreased, with the strength of the coupling being increased.

The present invention is now disclosed for merely exemplifying and non-limitative purposes in the figures of the hereto attached drawing tables.

FIG. 1 shows a front view of a widener roller equipped with couplings according to the present invention.

FIG. 2 shows a sectional view according to path II—II of FIG. 1, of a coupling according to the present invention, mounted on the widener roller of FIG. 1.

FIG. 3 shows a partial sectional view of the only coupling as of FIG. 2.

By referring to the above figures, the coupling of the present invention, generally indicated by the reference numeral 1 and used on a widener roller 8, comprises a couple of ring-shaped flanges 5 having an "L"-shaped cross-section, and positioned sideways to a ring-shaped element 9 of a flexible material. Each flange 5 is formed by a first ring 6, and a second ring 7 of a metal material, positioned substantially perpendicular to each other.

The first metal ring 6 is flat, whilst the second metal ring 7 is slightly concave, with its highest concavity being in correspondence of a point indicated by H, which, together with the same point H of the sound metal ring 7 relevant to the second flange of the coupled of flanges, define an axis (H—H) substantially parallel to the portion of the axis G—G of the widener roller 8 concerned by the coupling in question. The axis G—G is neutral relatively to the bendings occurring in the coupling, as it will become more evident from the following disclosure of the operating way.

The ring-shaped element 9 of flexible material, is constituted of rubber caused to adhere to the second metal rings 7 of the flanges 5, having a smooth surface, or a surface provided with protrusions, or a toothed surface, during the step of vulcanization or bonding of the same surface, so that the side surfaces 16 of the ring-shaped element 9 form an unitory body with the second metal rings 7.

Of the remaining surfaces of the ring-shaped element 9, the surface facing the interior of the same coupling, indicated by the reference numeral 10, is flat, and the external surface 11 is subdivided into two half-planes 11A and 11B by a hollow 12 having such a depth, as to come to the nearby of the axis H—H. The half-planes 11A and 11B are convergent towards the outside of the hollow 12, in order to better adhere, during the coupling assembling step, acting as a tight-sealing gasket, to the inner, depressed surfaces 13 of the edges 14 of the rolls 2, as it is better explained in the following.

The rolls 2 are mounted on the central, bent shaft 4 of the widener roller 8, and are bonded to each other by interposing, between the surfaces of the first metal rings 6 and the inner, depressed surfaces 13 of the edges 14, a layer of an epoxy or cyanamide glue, or of a different glue of a similar kind.

Simultaneously, the half-planes 11A and 11B of the ring-shaped element 9 are compressed and lined-up, according to a same surface 11, also they coming to adhere, so as to favour the bond, due to the effect of the interposed glue, between said half-planes and the respective inner, depressed surface 13 of the edge 14.

The adjacent rolls remain separated by a small slot 15, whose axis coincides with the axis of the hollow 12. Durng the operation of the widener roller 8, the shaft 4 does not revolve, whilst all rolls 2 revolve around the bent shaft 4, driven to revolve by the sheet material, or by driving motor means (not shown in the figures), according to the particular form of embodiment of the widener roller, in a per se perfectly known way.

During such revolution, each ring-shaped flange 5 bonded to a roll 2 tilts relatively to the ring-shaped flange 5 of the same coupling 1 associated with the roll 2 adjacent to the preceding.

Each portion of elastic element 9 is stressed by the alternate bending, according to arrows "F" and "L", according to the position in which said portion comes to be relatively to the axis G—G of the widener roller 8.

During the bending according to the arrows "F", the portion of ring-shaped element 9 positioned, relatively to the axis H—H, close by the hollow 12 results compressed to only a minimum extent, due to the effect of the same hollow 12, which makes it possible the stresses to be discharged, by favouring the flexibility, whilst the remaining portion of elastic element, positioned at the opposite side of the axis H—H, results is compressed.

The portions of material which are in correspondence of the axis G—G result substantially free from stresses. The same situation occurs, but with reversed stresses, in case of bending according to arrows "L".

According to an alternative form of practical embodiment of the coupling 1, the rings 5 may be also made from reinforce synthetic resins.

I claim:

1. A widener roller comprising:

(a) a stationary, bent shaft;

(b) at least first and second cylindrically shaped rolls adapted to rotate about said bent shaft, each roll comprising end portions; and (c) a coupling interposed between said first and second rolls to impart a rotational motion from one roll to the other, said coupling comprising:

(1) a ring-shaped element made of an elastic material, said ring-shaped element comprising an external surface, and opposite first and second side surfaces; and (2) first and second annularly-shaped flanges, each flange comprising first and second rings, said first and second rings being disposed substantially perpendicular with respect to each other, so that each of said first and second flanges has an "L-shaped" cross section, said first ring of each of said first and second flanges being fastened to one of said end portions of said first and second rolls respectively, and said second ring of said first and second flanges being fastened to said first and second side surfaces of said ring-shaped element respectively, whereby said first and second rolls impart alternate bending stresses to said first and second side surfaces of said elastic element via said first and second flanges respectively as said first and second rolls rotate about said bent shaft.

2. The widener roller as claimed in claim 1, wherein said first ring of each of said first and second flanges is fastened by means of glue to one of said end portions of said first and second rolls, respectively.

3. The widener roller as claimed in claim 1, wherein said second ring of each of said first and second flanges is fastened by means of vulcanization to said first and second side surfaces, respectively.

4. The widener roller as claimed in claim 1, wherein said second ring of each of said first and second flanges is fastened by means of glue to said first and second side surfaces, respectively.

5. The widener roller as claimed in claim 1, wherein said elastic element has an axis and a ring-shaped hollow extending from said external surface towards said axis so that said hollow divides said external surface into first and second external surfaces.

6. The widener roller as claimed in claim 5, wherein said first and second external surfaces converge towards the outside of said hollow.

7. The widener roller as claimed in claim 1, wherein said second ring of each of said first and second flanges is fastened to said first and second side surfaces respectively along first and second inclined surfaces converging towards the interior of said elastic element and intersecting each other to define an enclosed line, said enclosed line of said first and second flanges defining therebetween a cylindrical surface through said ring-shaped elastic element about which the alternating bending stresses are applied by said first and second flanges to said elastic element as said first and second rolls and said coupling rotate together about said bent shaft.

* * * * *